United States Patent [19]

Herz

[11] Patent Number: 5,035,487

[45] Date of Patent: Jul. 30, 1991

[54] METHOD AND APPARATUS FOR RELEASABLY MOUNTING AN OPTICAL DEVICE

[75] Inventor: Rudolf Herz, Baisweil, Fed. Rep. of Germany

[73] Assignee: Leupold & Stevens, Beaverton, Oreg.

[21] Appl. No.: 564,459

[22] Filed: Aug. 8, 1990

[30] Foreign Application Priority Data

Aug. 8, 1989 [DE] Fed. Rep. of Germany ..... 8909502

[51] Int. Cl.[5] ..... G02B 7/02

[52] U.S. Cl. ..... 350/245; 350/251; 350/252; 350/319

[58] Field of Search ..... 350/245, 242, 243, 248, 350/251, 252, 257, 319, 97; 248/688, 689, 151, 124, 188, 188.1, 188.4, 188.8

[56] References Cited

U.S. PATENT DOCUMENTS

| | | | |
|---|---|---|---|
| 1,806,422 | 5/1931 | Shaen | 350/251 |
| 2,554,544 | 5/1951 | Warner | 350/251 |
| 3,752,569 | 8/1973 | Nelson et al. | 350/257 |
| 4,488,774 | 12/1984 | Kagayama | 350/97 |
| 4,927,237 | 5/1990 | Hart | 350/319 |

*Primary Examiner*—Bruce Y. Arnold
*Assistant Examiner*—Loha Ben
*Attorney, Agent, or Firm*—Stoel Rives Boley Jones & Grey

[57] ABSTRACT

A method and apparatus for releasably mounting an optical device on a support member in a rapid, repeatable and precise manner is provided. The mounting system is especially suitable for releasably mounting an optical device such as a sighting scope on a projectile firing apparatus such as a rifle. The mounting system includes one or more studs, each having a groove provided therein, and a corresponding number of rotating shafts. Each rotating shaft interacts with the groove in the corresponding stud to releasably lock the studs in a support member. Each stud is mounted directly or indirectly on an optical device, and each rotating shaft is received in a support member mountable, for example, on a projectile firing apparatus.

18 Claims, 4 Drawing Sheets

METHOD AND APPARATUS FOR RELEASABLY MOUNTING AN OPTICAL DEVICE

TECHNICAL FIELD

The present invention relates generally to methods and apparatus for releasably mounting an optical device, such as an optical magnifying device, on a support member in a precise and repeatable manner.

BACKGROUND OF THE INVENTION

Projectile firing apparatus such as rifles are often equipped with optical devices for sighting, such as scopes. Since each sighting device provides a specific magnification and field of view, different optical devices may be preferred for particular situations, depending upon factors such as the type of target, the estimated distance to the target, field conditions, and the like. Moreover, optical sights for use with projectile firing apparatus may be designed for specific ambient light conditions. Such optical devices may be releasably mounted to permit the user to interchange different sighting devices and to facilitate storage and transport of both the optical device and the projectile firing apparatus.

To produce consistent and accurate results, the optical device must be precisely and repeatably mounted on its support. It would also be advantageous to employ releasable mounting means that are easy to use and permit rapid mounting and dismounting of the optical device. Projectile firing apparatus such as guns provide an additional challenge for releasably mounting optical devices. Upon firing, the gun recoils. An optical device mounted on a gun must not move or become misaligned as a result of recoil, since field conditions ordinarily do not permit realignment of the sight after each shot is fired.

Rifle scopes are conventionally mounted to a rifle support member by means of a Suhler hock mount, a swing mount, or a flip/slide mount. Each of these mounting systems provides releasable mounting of a rifle scope, but none of these mounts provides a quick release system that facilitates interchanging scopes during use in the field. In the mounting systems recited above, recoil is absorbed at a single location, at the front foot, the swing stud, or the front clamping, respectively. The rifle scope therefore tends to become misaligned after repeated firing, and substantial mechanical stresses may be sustained at the location where recoil is absorbed.

SUMMARY OF THE INVENTION

The present invention relates to a mounting system providing rapid, repeatable, precise, and releasable mounting of an optical device on a support member. The mounting system of the present invention includes one or more studs and rotating shafts, each having a groove provided therein, which interact to releasably lock the studs in a support member. Each stud is preferably mounted directly or indirectly on the optical device, and each rotating shaft is received in a support member mountable on the projectile firing apparatus, or the like. In an unlocked condition, the grooves on the studs and rotating shafts face one another and the studs and locking shafts are not in contact. As each rotating shaft is rotated, the shaft portion of each locking shaft engages the groove in each stud to releasably mount the optical device on the support member. This design permits rapid and precise releasable mounting, and additionally provides even distribution of recoil to each of the studs. The mounting system is therefore less prone to mechanical stresses and failures and provides precise, repeatable positioning of an optical device or similar mechanism over long periods of use.

BRIEF DESCRIPTION OF THE DRAWINGS

The above-mentioned and additional features of the present invention and the manner of obtaining them will become apparent, and the invention will be best understood by reference to the following more detailed description, read in conjunction with the accompanying drawings, in which.

DESCRIPTION OF THE PREFERRED EMBODIMENTS

Figure 1:
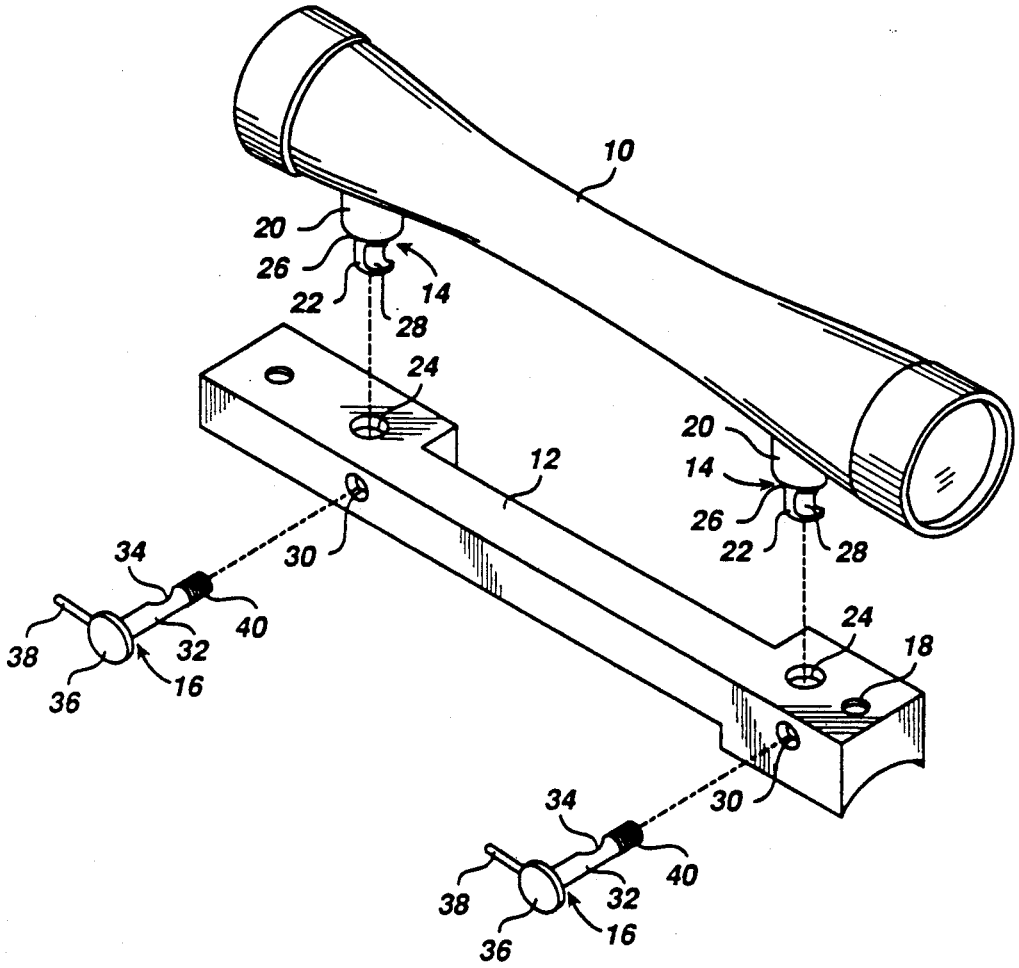
FIG. 1 shows an isometric view of an optical device mountable on a support member employing the mounting system of the present invention, wherein the studs are mounted directly on an optical device.

As shown in FIG. 1, an optical device 10 is mountable on a support member 12 and may be releasably locked in its mounted position as a result of the interaction of studs 14 and rotating shafts 16. Any optical device suitable for mounting on a portable or stationary support member may be mounted in accordance with the mounting system of the present invention. Rifle scopes, such as the Fixed Power rifle scope series available from Leupold & Stevens, Inc., which includes 4X, 6X, 6x42 mm, 8X, 8x36 mm, and 12X scopes, are exemplary optical devices 10 releasably mountable on a support member in accordance with the present invention. Support member 12 is mountable on a projectile firing apparatus such as a rifle, by means of suitable fasteners passing through mounting bores 18 and fastening to the apparatus. Alternatively, support member 12 may be formed as a part of or integrally with the projectile firing apparatus or the like.

In the embodiment shown in FIG. 1, studs 14 are formed integrally with or operably connected to optical device 10, such that each stud 14 protrudes from a lower surface of optical device 10 A "lower" surface is defined as a surface of optical device 10 adjacent support member 12 when optical device 10 is oriented properly for use and mounted on support member 12. Studs 14 are preferably located generally symmetrically with respect to the ends of optical device 10 and preferably have a generally cylindrical configuration.

As shown in the preferred embodiment of FIG. 1, each stud 14 comprises an upper cylindrical portion 20 having a larger diameter than lower portion 22. During the mounting operation, lower portion 22 of each stud 14 is received in a stud receiving bore 24, and shoulder 26 rests on the upper surface of support member 12. The length of upper cylindrical portion 20 between optical device 10 and shoulder 26 therefore determines the distance between optical device 10 and support member 12 when the optical device is mounted thereon, and may be varied as conditions require.

Lower portion 22 of each stud 14 is provided with a groove 28, which is preferably curved in a generally symmetrical configuration. Groove 28 preferably has a configuration corresponding generally to the contour of rotating shaft 16, so that the shaft portion of rotating shaft 16 is slidably rotatable about its central longitudinal axis in groove 28. Where multiple studs are provided, grooves 28 on studs 14 are preferably oriented in the same direction, as shown in FIG. 1. In this configuration, each rotating shaft is rotated in the same direction to mount each stud, and the locking operation is the same for each stud 14.

Rotating shafts 16 are generally cylindrical and, as shown in FIG. 1, include a shaft portion 32 having a groove 34 provided therein. Additionally, rotating shafts 16 comprise an enlarged head 36 at one end having a locking lever 38 mounted thereon, and a threaded portion 40 provided on shaft portion 32 opposite enlarged head 36. Groove 34 provided in each rotating shaft 16 is preferably curved in a generally symmetrical configuration. Groove 34 preferably has a configuration corresponding generally to the contour of stud receiving bore 24. The innermost point along groove 34 is located at a position corresponding approximately to the central longitudinal axis of rotating shaft 16.

Support member 12 is provided with stud receiving bores 24 opening through its upper surface. Each stud receiving bore 24 is sized and located to receive lower portion 22 of stud 14 therein. Additionally, rotating shaft receiving bores 30 open through a front surface of support member 12. Rotating shaft receiving bores 30 are sized and configured to receive rotating shafts 16 therein, and are preferably provided with an internally threaded portion matching threaded portion 40 of rotating shaft 16, so that rotating shafts 16 may be rotatably mounted and retained in rotating shaft receiving bores 30.

The central axes of stud receiving bores 24 and rotating shaft receiving bores 30 are generally perpendicular to one another. Rotating shaft receiving bores 30 are offset from but intersect stud receiving bores 24. In a preferred embodiment, the central axis of each rotating shaft receiving bore 30 is preferably generally tangential to an outer wall of stud receiving bore 24. According to preferred embodiments, rotating shaft receiving bores 30 and shaft portions 32 have a smaller diameter than stud receiving bores 24 and lower portions 22 of studs 14, respectively.

Figure 2:
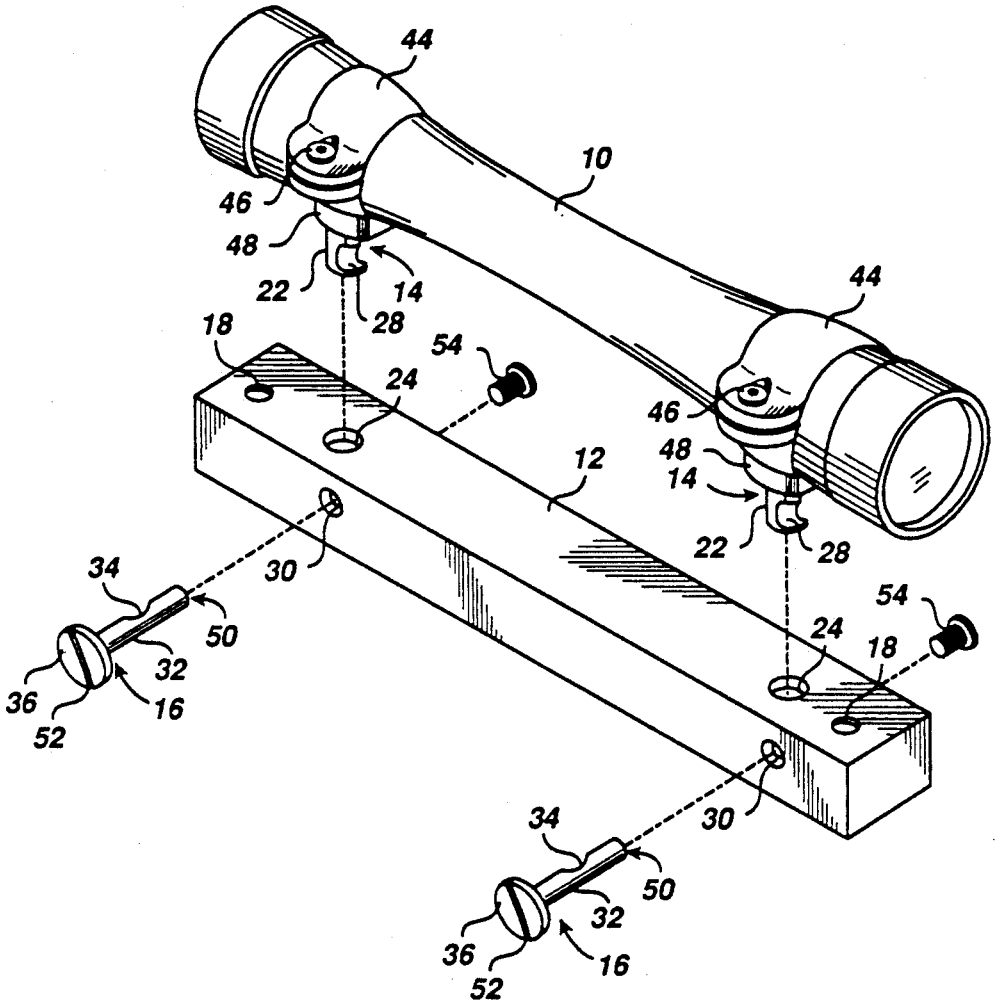
FIG. 2 shows an isometric view of an optical device mountable on a support member employing the mounting system of the present invention, wherein the studs are mounted indirectly on the optical device.

An alternative embodiment of the mounting system of the present invention is illustrated in FIG. 2. Components that are substantially similar to those shown and described with reference to FIG. 1 have been labelled with the corresponding reference numerals, and only the alternative embodiments will be described in detail.

In the embodiment illustrated in FIG. 2, studs 14 are mounted indirectly, and thereby removably, on optical device 10. Studs 14 are mounted on or formed integrally with mount rings 44 adapted to encircle optical device 10. Mount rings 44 are removably mountable on optical device 10 by means of fasteners 46. A single fastening location may be provided, as shown in FIG. 2, with each mount ring 44 having a generally annular configuration, or two fastening locations may be provided when mount ring 44 is provided as two separate components, each having a generally semi-circular configuration. An enlarged mount 48 is mounted on or formed integrally with mount rings 44 and abuts the upper surface of support member 12 when optical device 10 is in a mounted position. Enlarged mounts 48 function similarly to upper portions 20 of studs 14 in the embodiment illustrated in FIG. 1.

Rotating shafts 16 are received in rotating shaft receiving bores 30 and may be rotatably retained therein by means of screw fasteners 54 threadedly engageable in an internally threaded bore 50 of rotating shaft 16. Enlarged head 36 provided at one end of rotating shaft 16 has a slot 52 to facilitate rotation of rotating shafts 16 during the mounting operation.

In operation, rotating shafts 16 interact with grooves 28 in studs 14 to releasably lock studs 14 in stud receiving bores 24. Rotating shafts 16 are rotatable about their central longitudinal axes in rotating shaft receiving bores 30 between an unlocked position wherein studs 14 (and thereby optical device 10) may be removed from or inserted into stud receiving bores 24, and a locked position wherein studs 14 are securely retained in support member 12. The locking and unlocking operations are accomplished by rotation of rotating shafts 16 approximately 180° about their central longitudinal axes.

Figure 3:
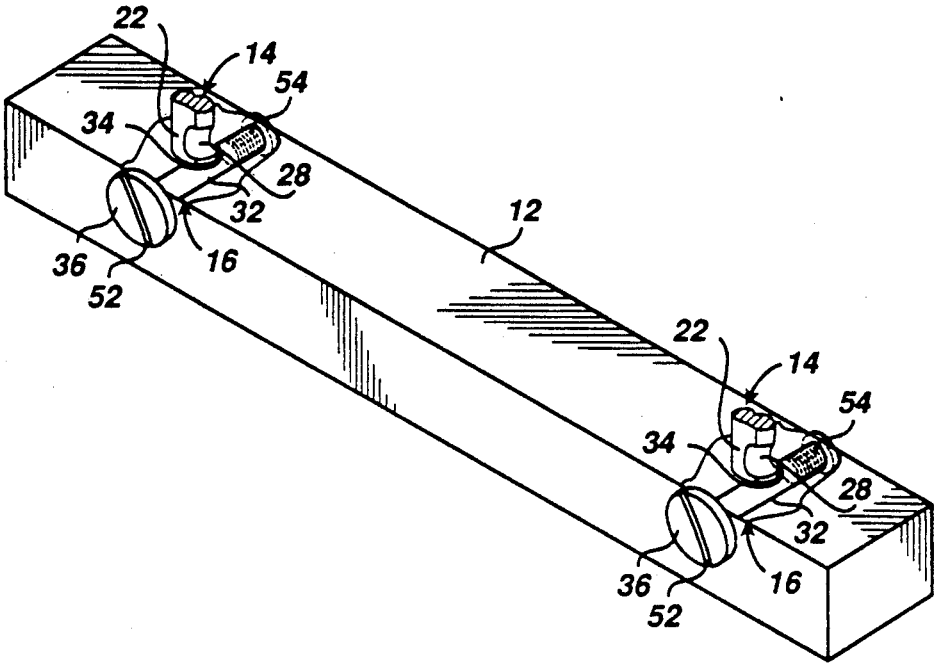
FIG. 3 shows an isometric, partially broken-away view of a support member illustrating the position of the studs and rotating shafts in an unlocked condition.
Figure 5:
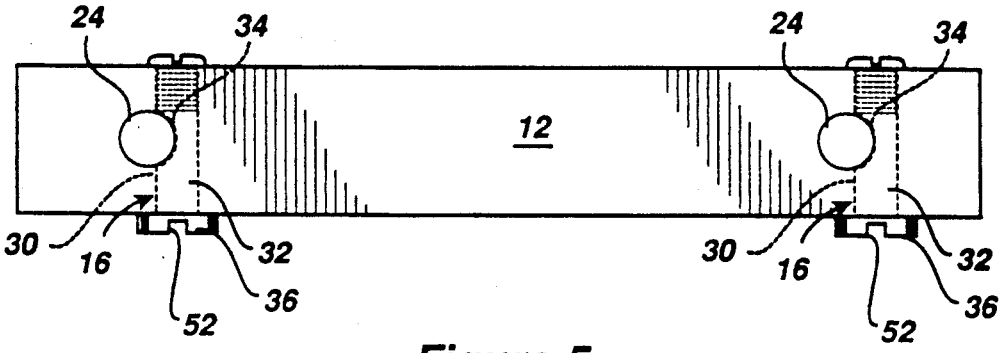
FIG. 5 shows a top view illustrating the rotating shafts (shown in phantom) in an unlocked position.

FIG. 3 illustrates the relative positions of studs 14 and rotating shafts 16 in an unlocked configuration of the mounting system as studs 14 are being inserted into stud receiving bores 24, and FIG. 5 illustrates the position of rotating shafts 16 in their unlocked condition. In the unlocked configuration, groove 34 in each rotating shaft 16 is aligned with and forms part of the cylindrical wall of each stud receiving bore 24. Studs 14 are thus insertable in stud receiving bores 24, with grooves 28 facing grooves 34 of rotating shafts 16, as illustrated in FIG. 3. In this unlocked configuration, studs 14 are freely movable in an axial direction into and out from stud receiving bores 24.

Figure 4:
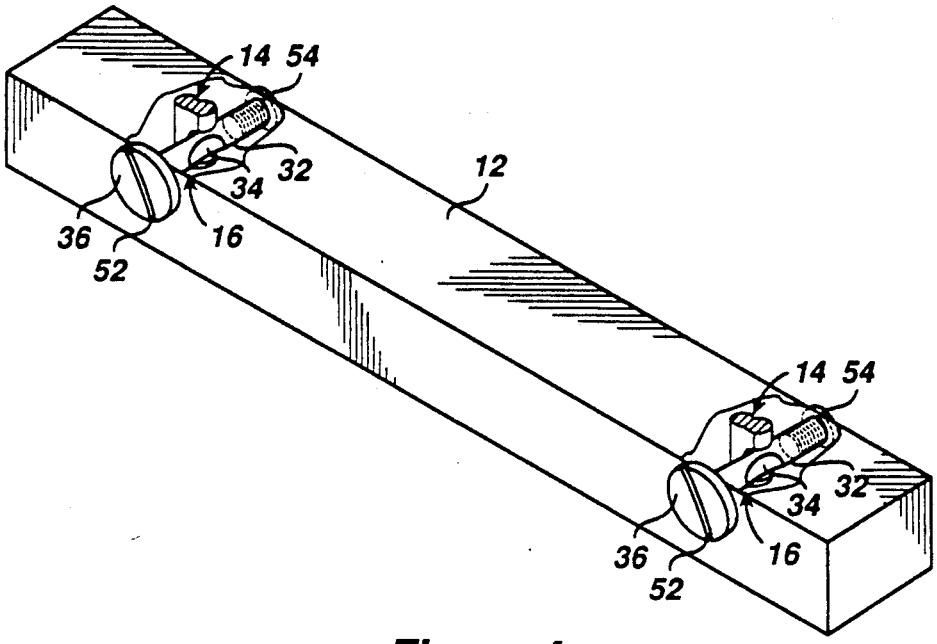
FIG. 4 shows an isometric, partially broken-away view of a support member illustrating the position of the studs and rotating shafts in a locked condition.
Figure 6:
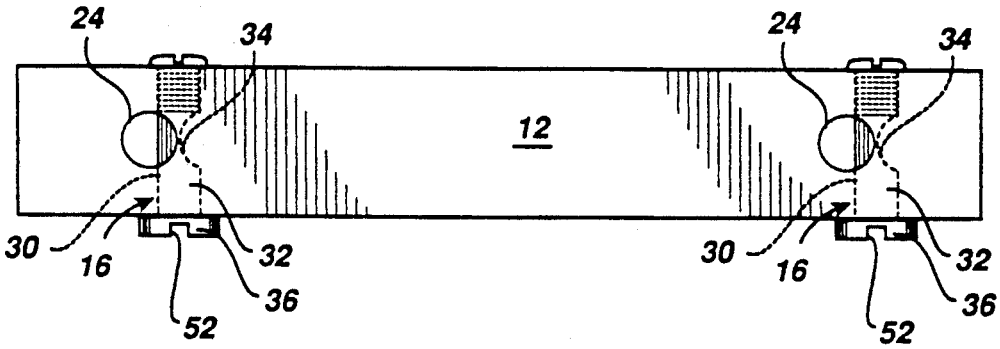
FIG. 6 shows a top view illustrating the rotating shafts (shown in phantom) in a locked position.

After studs 14 have been positioned in stud receiving bores 24, the locking operation is achieved by rotation of rotating shafts 16. Upon rotation of each rotating shaft 16 approximately 180° about its central longitudinal axis, shaft portion 32 of each rotating shaft 16 is engaged in groove 28 of each stud 14 to securely mount each stud 14 in support member 12. FIG. 4 illustrates the relative positions of studs 14 and rotating shafts 16 in a locked configuration of the mounting system, and FIG. 6 illustrates the position of rotating shafts 16 in the locked position. In the locked position, grooves 34 in rotating shafts 16 face the wall of rotating shaft receiving bores 30, as shown in FIG. 6. Rotation of rotating shafts 16 to the locked configuration is facilitated by slot 52 or locking lever 38 on enlarged shaft head 36.

Rotating shafts 16 are preferably rotated in a direction whereby the uppermost shaft portion defining groove 34 contacts the uppermost portion of stud 14 defining groove 28. The "uppermost" rotating shaft and stud portions are defined, in the context of this mounting system, as those portions nearest optical device 10. Each stud 14 is thereby pulled downwardly and tightened in stud receiving bore 24 by the interaction of shaft portion 32 with groove 28, to secure each stud 14 in support member 12. In the embodiments illustrated in FIGS. 1-4, rotation of rotating shafts 16 in a counterclockwise locking direction is preferred.

To remove optical device 10 from support member 12, rotating shafts 16 are rotated 180° about their longitudinal axes from their locked position. The unlocking, or releasing direction of rotation is preferably opposite from the locking direction (i.e., clockwise in the embodiments of the present invention shown in FIGS. 1–4). To facilitate proper rotation during the unlocking operation, stops may be provided by threads (not shown) on rotating shafts 16 and within the rotating shaft receiving bores 30.

Two studs and rotating shafts are preferably employed to releasably mount optical device 10 to support member 12. This arrangement permits recoil to be absorbed at two spatially separated locations during operation of a gun, or the like. The amount of recoil absorbed at each mounting location is therefore reduced by 50%. The mounting system of the present invention is consequently less prone to loosening and misalignment. Obviously, a further reduction in recoil per recoil absorption location can be obtained using a higher number of mounting locations; however, spatial and other considerations suggest that two such locations are preferred.

As a result of the simplicity of the locking and unlocking operations involved in use of the mounting system of the present invention, optical devices 10 may be rapidly and easily mounted and released from a support member. Consequently, both the time required to instruct a user in the mounting and release operations and the time required for a user to perform such operations are reduced. Mounting or releasing an optical sighting device 10 from a projectile firing apparatus may be accomplished by an experienced user within seconds.

While the mounting system of the present invention has been shown and described with reference to optical devices such as rifle scopes, the mounting apparatus and methods of present invention are useful for mounting other optical devices, aiming devices and the like. Likewise, while the foregoing description relates to mounting devices on projectile firing apparatus such as rifles, pistols and the like, the mounting system of the present invention is useful for mounting optical or other devices on other types of apparatus, such as tripods and the like, that may be stationary or portable.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

What is claimed is:

1. A mounting system for releasably mounting an optical device, comprising:

a support member having at least one stud receiving bore and at least one rotating shaft receiving bore formed therein;

at least one stud having a groove formed therein operably connectable to the optical device and capable of being received within the stud receiving bore; and at least one rotating shaft having a groove formed therein and capable of being received within said rotating shaft receiving bore, said rotating shaft engageable with the groove formed in said stud in a locked position and disengageable with the groove formed in said stud in an unlocked position.

2. A mounting system according to claim 1, comprising two studs and two rotating shafts.

3. A mounting system according to claim 1, wherein said at least one stud receiving bore intersects a corresponding rotating shaft receiving bore.

4. A mounting system according to claim 3, wherein said at least one stud receiving bore has a central axis arranged generally perpendicular to a central axis of said corresponding rotating shaft receiving bore.

5. A mounting system according to claim 4, wherein the central axis of said at least one rotating shaft receiving bore is generally tangential to a corresponding stud receiving bore.

6. A mounting system according to claim 1, wherein multiple studs are operably connected to the optical device and each of the studs is oriented similarly.

7. A mounting system according to claim 1, wherein said at least one stud is generally cylindrical.

8. A mounting system according to claim 1, wherein said at least one stud comprises an upper generally cylindrical portion and a lower generally cylindrical portion, the lower portion having a smaller diameter than the upper portion and having the groove formed therein.

9. A mounting system according to claim 1, wherein said at least one stud is mounted directly on the optical device.

10. A mounting system according to claim 1, wherein said at least one stud is mounted indirectly on the optical device.

11. A mounting system according to claim 10, wherein said at least one stud is mounted to a mount ring, and said mount ring is removably mountable on the optical device.

12. An mounting system according to claim 1, wherein respective grooves formed in said at least one stud and said at least one rotating shaft are curved and generally symmetrical.

13. A mounting system according to claim 1, wherein said at least one rotating shaft has a generally cylindrical shaft portion and the groove is formed in the generally cylindrical shaft portion.

14. A mounting system according to claim 1, wherein said at least one rotating shaft comprises: a generally cylindrical shaft portion having the groove formed therein; an enlarged head portion disposed at one end of the shaft portion; means for facilitating rotation of the shaft portion provided in conjunction with the enlarged head portion; and means for removably mounting the shaft portion in the rotating shaft receiving bore.

15. A mounting apparatus according to claim 1, wherein the groove formed in said at least one stud has a configuration corresponding generally to the contour of a shaft portion of the rotating shaft.

16. A method for rapidly and releasably mounting an optical device, the method comprising the steps of:

(a) operably connecting at least one stud to the optical device;

(b) aligning said at least one stud with a stud receiving bore provided in a support member and inserting said at least one stud into the stud receiving bore;

(c) locating a rotating shaft in an unlocked position in a rotating shaft receiving bore in the support member; and (d) rotating the rotating shaft approximately 180° to a locked position, thereby locking the optical device on the support member.

17. A method according to claim 16, further comprising the step of mounting the support member on a projectile firing apparatus.

18. A method according to claim 16, wherein during the step of rotating the rotating shaft to a locked position, a shaft portion of the rotating shaft engages with a groove in said at least one stud.

* * * * *

UNITED STATES PATENT AND TRADEMARK OFFICE

CERTIFICATE OF CORRECTION

PATENT NO. : 5,035,487

DATED : July 30, 1991

INVENTOR(S) : Rudolf Herz

It is certified that error appears in the above-identified patent and that said Letters Patent is hereby corrected as shown below:

Column 2, line 58 "10" should be --10--.
Column 6, line 38 "An" should be -- A--.

Signed and Sealed this

Twenty-ninth Day of December, 1992

*Attest:*

DOUGLAS B. COMER

*Attesting Officer*

*Acting Commissioner of Patents and Trademarks*